United States Patent [19]

Lamarche et al.

[11] Patent Number: 4,571,852

[45] Date of Patent: Feb. 25, 1986

[54] ANTI-SKIDDING SOLE

[75] Inventors: Raymond B. Lamarche, Acton Vale; Baldev Bhandari, Granby; Rémi Desaultels; Pierre Drolet, both of Acton Vale, all of Canada

[73] Assignee: Les Caoutchoucs Acton Ltee, Canada

[21] Appl. No.: 649,961

[22] Filed: Sep. 11, 1984

Related U.S. Application Data

[63] Continuation of Ser. No. 422,702, Sep. 24, 1982, abandoned.

[51] Int. Cl.[4] ..... A43B 13/00; A43B 13/04

[52] U.S. Cl. ..... 36/32 R; 36/59 C; 36/25 R; D2/320

[58] Field of Search ..... 36/25 R, 32 R, 103, 36/116, 590, 7.6, 7.7, 102, 28; D2/320

[56] References Cited

U.S. PATENT DOCUMENTS

| | | | |
|---|---|---|---|
| D. 114,340 | 4/1939 | MacLeod | D2/320 |
| D. 259,595 | 6/1981 | Famolare, Jr. | D2/320 |
| 1,120,082 | 12/1914 | Rhodes | 36/25 R |
| 2,365,027 | 12/1944 | Urbany | 36/32 R |
| 2,553,616 | 5/1951 | Walls | 36/29 |
| 3,593,436 | 7/1971 | Vietas | 36/32 R |

*Primary Examiner*—Henry S. Jaudon
*Assistant Examiner*—Steven N. Meyers
*Attorney, Agent, or Firm*—Steele, Gould & Fried

[57] ABSTRACT

An anti-skidding sole made of rubber or similar material, for boot or shoe. This sole has a lower surface provided with at least one integral, rib-like member projecting downwardly therefrom. This rib-like member is in the shape of a spiral and has an overall bottom surface which is substantially flat. Due to the spiral shape of this rib-like member, the air, water and/or oil boxed up under the sole may escape therefrom without forming an air or liquid cushion, and thus may allow the sole to positively contact the ground where the rib-like member provides anti-skid edges in every direction.

12 Claims, 7 Drawing Figures

ANTI-SKIDDING SOLE

This is continuation of application Ser. No. 422,702, filed Sept. 24, 1982, now abandoned.

The present invention relates to an anti-sikdding sole made of rubber or similar material, for boot or shoe.

Anti-skidding soles are already known, which are made of rubber and comprise a plurality of rib-like members in the shape of concentrical circles projecting downwardly to povide anti-skid edges. The advantage of using such circular rib-like members lies in that the pressure exerted along way radius of the concentrical circles provides the sole with a higher, anti-skidding efficiency when the same is lying on the flat surface, as the circles provide a plurality of substantially parallel edges that prevent any skidding motion of the sole whatever be the direction of the exerted pressure. Due to the resiliency of the sole material, the edges also absorb the impact. Thanks to the room left between each pair of adjacent circles, the oil, water or fat spoiling the ground on which the sole lays, can distribute itself between the rib-like members over the given portion of the lower surface of the sole, and thus let the bottom surface of the rib-like members in permanent contact with the ground.

Examples for such soles are disclosed in U.S. design Pat. Nos. D-39,747 to McKenna, D-125,656 to Cutler and D-234,930 to Arambasic.

If these soles all have the above-mentioned advantage they also have an unobvious, major disadvantage in that water, oil and/or fat which stick to the bottom of the sole and/or enter the spaces between the rib-like members, cannot escape therefrom as these spaces are annular in shape. This makes the anti-skidding sole less efficient in particular when the wearer has to walk on very large oily surfaces.

Moreover, air between each pair of annular rib-like members can also been boxed up and prevent more direct contact of the sole with the sliding surface.

The object of the present invention is to provide an anti-skidding sole made or rubber of similar material, for boot and shoe, which sole overcomes the above-mentioned disadvantage.

The anti-skidding sole according to the invention comprises at least one rib-like member, preferably two integral to its lower surface and having an overall bottom surface substantially flat. Each rib-like member rolls up at least one time around a central point located on the longitudinal axis of the sole without closing up on itself in order to define all around the central point at least one opened, anti-skid edge for opposing any motion of the sole in any possible direction while simultaneously letting the air boxed up under the sole escape to avoid formation of an air cushion. This structure is particularly advantageous as the rib-like members which preferably have a spiral shape, allow the air to escape from under the sole and thus lets the bottom surface of this sole to actually contact the ground and therefore perform its anti-skidding effect. On the other hand, each rib-like member which is rolled up around a central point without closing up on itself allows any liquid such as fat or water, to escape from under the sole in an easier manner than with a sole having concentrical, rib-like members where liquid always remains boxed up without any possibility to escape.

It should be noted that a sole with a spiral, bottom design has already been patented in the United States under design U.S. Pat. No. D-114,340. However, it should be noted that the rib-like member of the sole disclosed in this design patent is a cord made of jute and rolled up about a central point. The general aspect of the sole disclosed in this design patent is very attractive but does not anticipate the very specific structure of the present invention, as the cord spiral does not provide any edges able to oppose skidding motion. Moreover, the fat can easily stick onto the cord and can even make the sole much more sliding than it is when dry. Moreover, air can escape through the cord itself, thus making the use of a spiral unnecessary.

According to a preferred embodiment of the invention, the sole is made of the chloroprene polymer sold under the trademark NEOPRENE.

According to another preferred embodiment of the invention, the sole comprises two rib-like members each in the shape of a spiral having its center located on the longitudinal axis of the sole under the heel portion and metatarsal portion of the sole, respectively.

According to a particular embodiment of the invention, the sole comprises at least two separate rib-like members in the shape of spirals having the same central point.

The invention will be better understood with reference to the following description taken in connection with the accompanying drawings wherein:

FIG. 3 is a cross-sectional, partial view of the sole shown in FIG. 1 when a vertical pressure is exerted there to;

Figure 1:
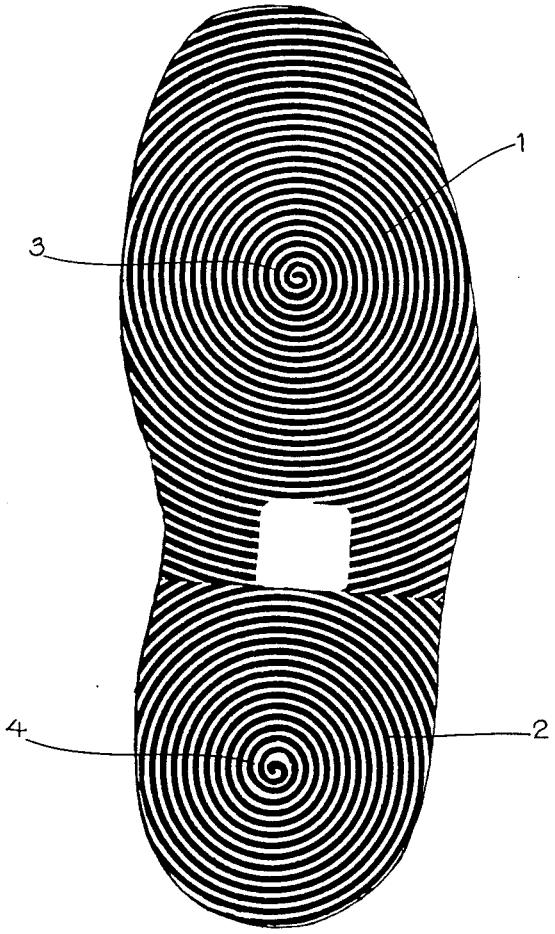
FIG. 1 is a top plan view of a bottom surface of an embodiment of sole according to the invention.

The anti-skidding sole shown in FIG. 1, comprises two rib-like members 1 and 2 each having the shape of a spiral. These spirals 1 and 2 have their centers 3 and 4 located onto, or close to, the longitudinal axis of the sole. The spirals 1 or 2 can be of any mathematical shape. It is not compulsory that their centers be strictly located onto the longitudinal axis of the sole. However, they must be located close to this axis. Indeed, when the spirals are located under the heel and metatarsal portions of the sole as shown in FIG. 1, that is at points of the sole where the pressure exerted by the wearer's foot is the highest, the frictional force applied against any slidding motionwill be identical in every direction, i.e. longitudinally or laterally, only if the centers of the spirals are located onto, or close to, the longitudinal axis. of the sole.

The improved, anti-skidding properties of the sole shown in FIG. 1 come from the plurality of whorls that extend tangentially to the direction of any motion applied by the foot in any direction outwards the surface of the sole. Actually, these whorls provide a plurality of anti-skidding edges that in turn provide contact surfaces which exert a frictional force against any skidding of the foot in any direction.

Figure 2:
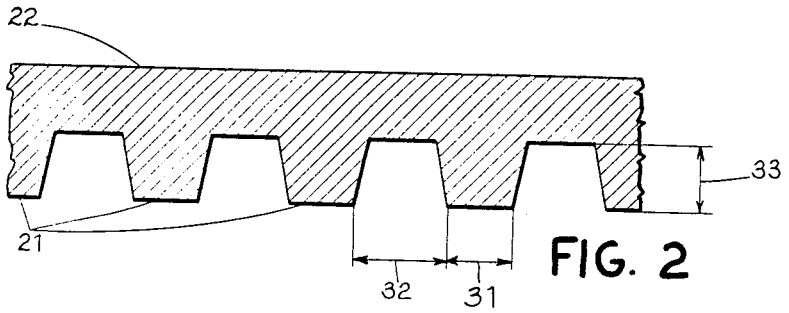
FIG. 2 is a cross-sectional view of the sole shown in FIG. 1 when no pressure is exerted thereto.
Figure 3:
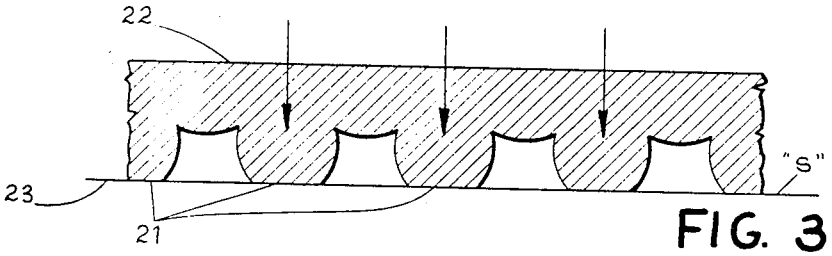
Figure 4:
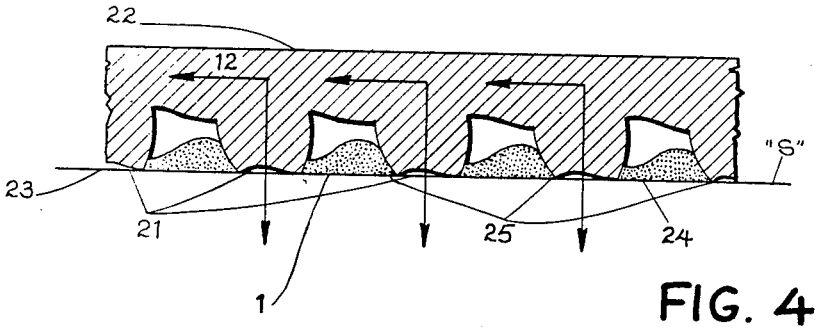
FIG. 4 is a cross-sectional view of the same sole when a pressure having both vertical and lateral components is exerted thereto.

FIGS. 2, 3 and 4 are partial cross-sectional views of the sole shown in FIG. 1. In FIG. 1, no pressure is exerted onto the sole. In FIG. 3, a pressure is applied onto the sole in the vertical direction. In FIG. 4, a pressure having both a vertical component 11 and lateral component 12 is exerted onto the sole.

In these figures, and more especially in FIG. 4, one can see that each whorl 21 permits to the sole 22 to contact the ground 23 even if this ground is spoiled with oil or fat 24. When the sole lays flat onto the ground, the oil located under the rib-like members is pushed away laterally by the vertical pressure 11 exerted onto the sole. This of course, allows the bottom surface of each whorl 21 to reach the ground. When a lateral pressure 12 is exerted in addition to the vertical pressure 11, the whorls 21 are slightly deformed. However, even in this case, the whorls 21 reach the ground 23 and provide a plurality of anti-skidding edges 25 in every direction all around the centers of the spirals.

As clearly shown in FIG. 2, the cross-section of each whorl 21 is in the shape of a regular trapezoid when no pressure is exerted onto the sole. The cross-sectional width of each rib-like member is substantially equal to the height 33 thereof, said width and height being in turn substantially equal to the distance 32 between a pair of adjacent whorls. Of course, these shape and dimension can be modified whenever necessary.

Nevertheless, it is important that the bottom surfaces of all the whorls of the rib-like members extend in an overall flat surface to provide a large contact surface between the sole and the ground and therefore a large contact surface against inadvertant slidding. This of course implies that the sole do not comprise a <<built-in>> arch.

In addition, the pseudo-parallel edges of the rib-like members act as wiper blades onto the ground to put away any slidding material (fat or oil) spoiling the ground and thus allow the overall bottom surface of the sole to reach the ground while ensuring an improved stability of the wearer onto the ground. The flexibility and/or resiliency of the material selected for making the sole may increase the wiping action of the sole onto the ground by allowing the bottom of the sole to follow any rigosity or uneveness of the ground.

Another advantage of the sole according to the invention lies in that the plurality of edges formed by the rib-like members <<break>> the slidding film or layer of oil or fat onto the ground and thus reduce the risk of slidding.

In the particular embodiment shown in FIG. 1, both spiral-shaped, rib-like memebers 1 and 2 have distinct centers spaced up from each other. The spirals both rotate in the same direction. However, it should be understood that these spirals could also rotate in opposite direction.

Figure 5:
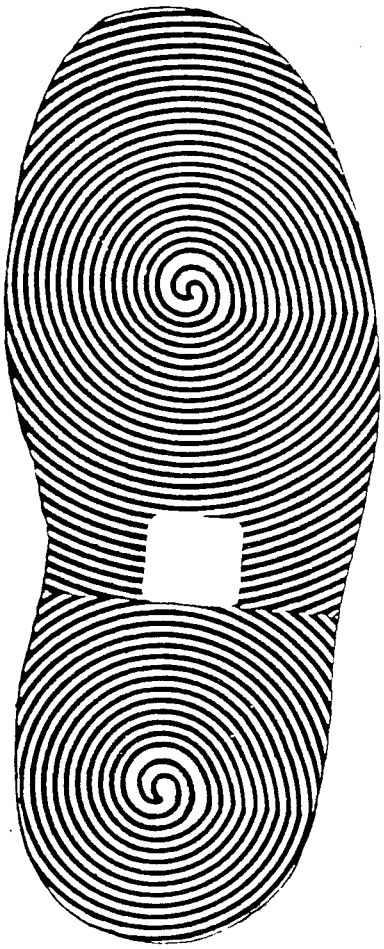
FIG. 5 is a top plan view of a bottom surface of another embodiment of sole according to the invention.

According to another embodiment of the invention shown in FIG. 5, the sole comprises two pair of spiral-shaped, rib-like members. The spirals of each pair are distinct from each other but both have the same center. These spirals of course rotate in the same direction.

Advantageously, the distance between each pair of adjacent whorls shall be substantially constant, so that the frictional force be identical in any direction.

Any kind or rubber or similar resilient material can be used for manufacturing the sole. However, in the very specific cases of soles intended for use in the food industries such as in slaughter-houses where the ground is covered and spoiled with animal fat, the selected material shall be of course non soluble into the fat.

Similarly, in garages or other industries where the floor is covered with oil, phthalic or aromatic compounds, etc., the sole material shall be appropriately selected. A multi-purpose material such as the chloroprene material sold under the trademark NEOPRENE can advantageously be used to make the sole usable in any kind of industries.

Preferably, use will be made of a mixture or rubber prepared from compounds not soluble into the animal fat, such as chloroprene, in combination with additives for softening the rubber to such an extent that this rubber may absorb the impact and have an increased frictional coefficient while keeping a suitable hardness.

Soles having the above-mentioned characteristics have been tried for a while onto the very slidding floors of several slaughter-houses. In such houses, the floor is usually spoiled with animal fat, water and other slidding material whose mixture make the known anti-skidding soles unefficient. The results obtained with the sole according to the invention were very positive.

Figure 6:
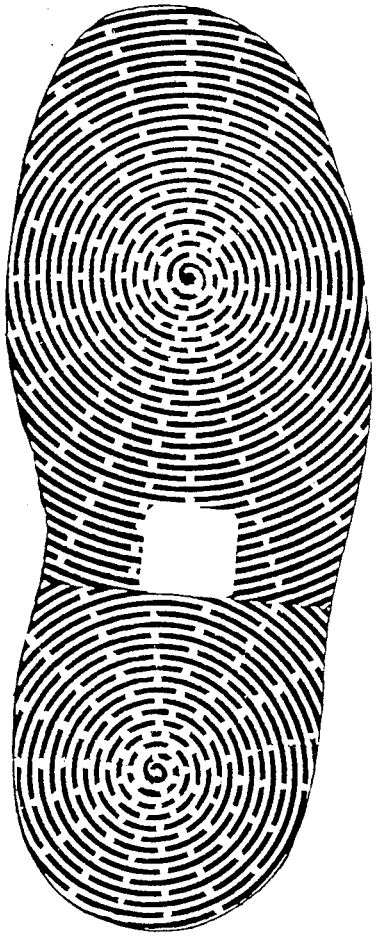
FIGS. 6 and 7 are top plan views of the bottom surfaces of two further embodiments of sole according to the invention.
Figure 7:
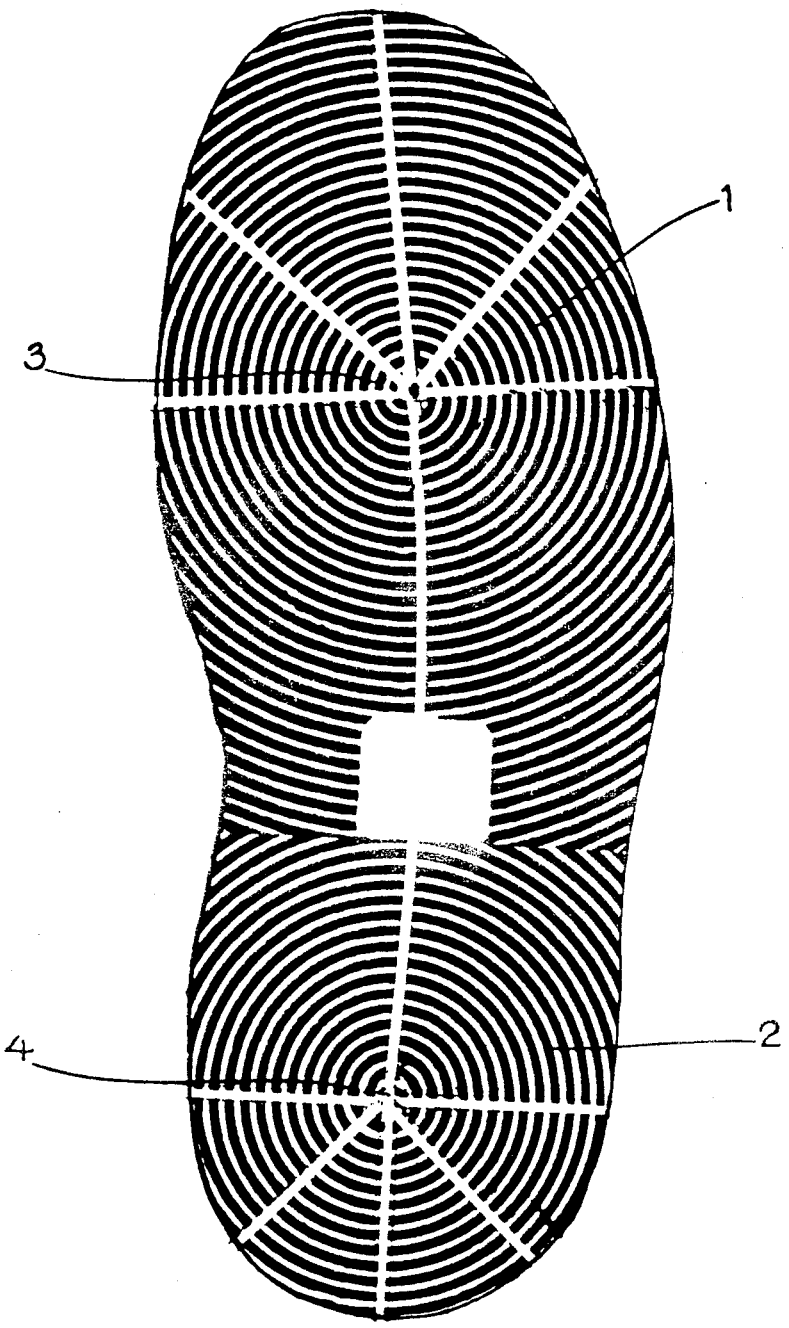

It is compulsory that the rib-like members have a shape that allows the fluid to flow from under the bottom of the sole. This can be obtained with spiral-shaped, rib-like members as disclosed hereinabove. However, this can also be obtained by using rib-like members in the shape of a plurality of sections that are all orientated so as to be sequent to a plurality of circles centered around at least one common point located onto the longitudinal axis of the sole so as to extend all around these common centers and to provide anti-skidding frictional edges in every direction. Such sections can be made from concentrical rings or spirals divided into sections either in a radial manner, as shown in FIGS. 6 and 7, or along parallel lines. On the other hand, the bottom surface of the sole can be provided with a plurality of linear, rib-like members having short length, provided that these members form anti-skidding edges which extend tangentially to a plurality of circles centered onto at least one point located in the middle part of the heel and/or metatarsal portions of the sole. It should be understood that some variations can be made within the scope of the invention provided that anti-skidding edges in every direction still remain onto the bottom of the sole.

It should also be understood that the sole according to the invention is by no way restricted to the very specific use mentioned hereinabove. Indeed, the sole according to the invention could also be used by way of example as anti-skidding sole for curling shoe or other sport shoe.

We claim:

1. An anti-skidding sole for boot or shoe, said sole being made of rubber or similar material and having a longitudinal axis and a lower surface comprising a metatarsal part and a heel part, wherein:

said lower surface comprises a first set of integral, rib-like members covering the entire surface of the metatarsal part of the sole and a second set of integral, rib-like members covering the entire surface of the heel part of said sole;

the rib-like members of said first and second sets have an identical, trapezoidal cross-section and comprise raised contact surfaces which altogether form a flat, overall bottom surface, across an arch area of the sole;

the rib-like members of the first set extend in a regular manner at a constant, radial distance from each other without closing up on themselves all around a first central point located on the longitudinal axis of the sole substantially in the middle of the metatarsal part of said sole; and the rib-like members of the second set extend in a regular manner at a constant, radial distance from each other without closing up on themselves all around a second central point located on the longitudinal axis of the sole substantially in the middle of the heel part of said sole, each of said rib-like members defining a plurality of anti-skidding edges evenly aligned circumferentially to said first and second central points in every direction from said central points to oppose a frictional force substantially identically in any direction to any skidding motion while simultaneously allowing air boxed-up under said sole to escape thereby avoiding formation of an air cushion.

2. The anti-skidding sole of claim 1 wherein its material is insoluble in the animal fats and oil.

3. The anti-skidding sole of claim 1, wherein the rib-like members of each set consist of a plurality of segments extending all around a plurality of concentric circles centered onto the longitudinal axis of the sole.

4. The anti-skidding sole of claim 3, wherein the segments are made from concentrical rings divided into sections.

5. The anti-skidding sole of claim 4, wherein the concentrical rings are divided out in a radial manner.

6. The anti-skidding sole of claim 1, wherein the rib-like members of each set form a continuous spiral having whorls winding up around the central point of said set.

7. The anti-skidding sole of claim 6, wherein the rib like members of each set form two continuous spirals winding up one inside the other around the central point of said set.

8. The anti-skidding sole of claim 6, wherein the width of the rib-like members is substantially equal to the constant, radial distance between every pair of adjacent whorls.

9. The anti-skidding sole of claim 8, wherein the height of said rib-like members is substantially equal to the constant, radial distance between every pair of adjacent whorls.

10. The anti-skidding sole of claim 6 wherein the spiral-shaped, rib-like members of said first and second sets wind up in opposite directions.

11. The anti-skidding sole of claim 6, wherein the spiral-shaped, rib-like members of said first and second sets wind up in the same direction.

12. The anti-skidding sole of claim 6 wherein the whorls of each of said spiral-shaped rib-like members are divided into a plurality of segments in order to allow a fluid located under the sole to flow out when the sole lays onto the ground.

* * * * *